US006751924B2

(12) United States Patent
Kobayashi

(10) Patent No.: US 6,751,924 B2
(45) Date of Patent: Jun. 22, 2004

(54) STRESS DISTRIBUTING HOLE FOR WINDOW SASH

(75) Inventor: Tetsuya Kobayashi, St-Georges de Beauce (CA)

(73) Assignee: Portes Patio Resiver Inc., Beauceville (CA)

( * ) Notice: Subject to any disclaimer, the term of this patent is extended or adjusted under 35 U.S.C. 154(b) by 82 days.

(21) Appl. No.: 10/127,586

(22) Filed: Apr. 23, 2002

(65) Prior Publication Data

US 2003/0159375 A1 Aug. 28, 2003

(30) Foreign Application Priority Data

Feb. 28, 2002 (CA) ..... 2373890

(51) Int. Cl.[7] ..... E06B 7/00

(52) U.S. Cl. ..... 52/786.1; 52/656.4; 52/656.5; 52/204.52; 156/304.6

(58) Field of Search ..... 52/786.1, 656.2, 52/656.7, 656.4, 656.5, 656.9, 209, 204.52; 156/73.5, 253, 304.6

(56) References Cited

U.S. PATENT DOCUMENTS 3,528,692 A * 9/1970 De Vries ..... 403/37
4,337,024 A 6/1982 Turner et al.
4,377,428 A 3/1983 Toth
4,601,768 A 7/1986 Bouyoucos et al.
4,601,927 A 7/1986 Durfee
4,944,118 A * 7/1990 Biro ..... 49/504
5,044,121 A * 9/1991 Harbom et al. ..... 49/401
5,748,409 A 5/1998 Girard et al.
5,902,657 A 5/1999 Hanson et al.
6,129,805 A * 10/2000 Valentin ..... 156/304.2
6,167,662 B1 * 1/2001 Gruber ..... 52/204.1
6,273,988 B1 * 8/2001 Zollinger et al. ..... 156/304.2
6,378,254 B1 * 4/2002 Gould ..... 52/204.63
6,490,839 B1 * 12/2002 Macquart et al. ..... 52/656.5
6,598,489 B1 * 7/2003 Van Cleve et al. ..... 73/861.357

* cited by examiner

*Primary Examiner*—Brian E. Glessner
(74) *Attorney, Agent, or Firm*—Ogilvy Renault; Guy J. Houle

(57) ABSTRACT

A windowed sash of the type having a window pane supported in a window sash. The window sash includes of elongated profiled polymeric members interconnected by weld seams at joints therebetween. The window sash is adapted to be mounted in a frame. Holes are provided in contact with the weld seams interconnecting the elongated profiled polymeric extruded members for distributing, at least partially, stress sustained by the window pane and the window sash when subjected to shocks, so as to prevent at least one of the weld seams, the elongated profiled polymeric extruded members and the window pane from cracking.

9 Claims, 4 Drawing Sheets

STRESS DISTRIBUTING HOLE FOR WINDOW SASH

TECHNICAL FIELD

The present invention generally relates to windowed members and, more particularly, to modifications to window sashes of windows formed of extruded polymeric materials, for improving the shock resistance of the windowed member.

BACKGROUND ART

Windowed members of all shapes and types, i.e., windows, swinging doors, sliding patio doors and the like, have evolved in the last years with the advent of new materials and manufacturing techniques. The sashes and frames that support the window panes have been modified extensively and departed from the traditional wood or metal materials to be replaced by extruded polymers, such as polyvinyl chloride (PVC). For instance, a window pane may be secured in a sash fabricated of elongated profiled polymeric extruded members forming rectangular frames. The process of extrusion enables the efficient production of high-density rigid members, with air pockets that ensure a high insulation value for these members. Furthermore, the assembly of elongated extruded members is easily performed by beveling end surfaces of the elongated members to then weld outer peripheries of the beveled surfaces of adjacent and perpendicular elongated members, to form a rectangular frame for supporting the window pane. In some instances, metal reinforcement is added to the rectangular frames formed of extruded members, such as steel or aluminum members.

The weld between the abutting joints of the polymeric members has been known to be a weak area of the structural component formed by the joined polymeric members. U.S. Pat. No. 4,601,768, issued to Bouyoucos et al. on Jul. 22, 1996, and U.S. Pat. No. 5,748,409, issued to Girard et al., on May 5, 1998, provide methods and apparatuses for overcoming the deficiencies related to the use of welding for interconnecting polymeric extruded members.

In the window industry, the windows are subject to high standards of quality and must go through series of tests in order to ensure their structural integrity. For instance, in the southeast regions of the United States and in the Caribbean countries, the standards have high thresholds, as these regions are subjected to severe weather conditions, including a hurricane season. In regions of Texas and in some parts of Florida, U.S.A., new standards have been established for testing the resistance to wind-borne debris impact. The tests involve the impacting of various missiles on various points of the window pane of a window. A typical standard for wind-borne debris impact testing of windowed doors consists of a large-missile impact test for windows, doors, skylights, glazing and shutters, in which a missile such as a 2×4 timber weighing 9 lb is impacted at two different locations on a window pane at 50 ft/sec, and the window pane must survive these impacts without penetration. The two different locations may be, for instance, at the center of the window pane and within six inches of a corner. The missile impact portions of the test are followed by cyclic pressure testing, which will have the windows subjected to cycles of outward- and inward-acting pressure. In order for a specimen to pass the impact tests, it must not have, for example, tears or cracks longer than five inches or openings through which a three-inch sphere can pass.

Some window frames or sashes formed of plastified elongated extruded members interconnected by weld seams have been known to fail by the cracking of the weld seam during such impact tests and/or following cyclic pressure testing. On the other hand, if the weld seams are rigid enough to sustain such impact testing without cracking, the window pane often does not resist the missiles, as the rigid weld seams do not absorb enough of the shock waves. The rectangular frames may even resist to the shock propagation of the window pane due to the high rigidity of the weld seams, and the window pane often shatters because of this.

SUMMARY OF INVENTION

It is a feature of the present invention to provide windowed members formed of extruded polymeric materials having an improved resistance to impact shock.

It is a further feature of the present invention to provide the windowed members having an improved resistance to impact shock without having metal reinforcement.

According to the above feature of the present invention, from a broad aspect, the present invention provides a windowed sash of the type having at least one window pane supported in a window sash. The window sash consists of elongated profiled polymeric members interconnected by weld seams at joints therebetween. The window sash is adapted to be mounted in a frame. At least one hole is in contact with at least one of the weld seams interconnecting the elongated profiled polymeric extruded members for distributing, at least partially, stress sustained by at least one of the window pane and the window sash when subjected to shocks so as to prevent at least one of the weld seams, the elongated profiled polymeric extruded members and the window pane from cracking.

According to a further broad aspect of the present invention, there is provided a method for increasing a shock resistance of a windowed sash. The windowed sash has a window sash being formed by elongated profiled polymeric extruded members interconnected at joints by weld seams, and a window pane supported in the window sash. The method comprises the step of providing at least one hole in contact with at least one of the weld seams for distributing, at least partially, stress sustained by at least one of the window pane and the window sash when subjected to shocks so as to prevent at least one of the weld seams, the elongated profiled polymeric extruded members and the window pane from cracking.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
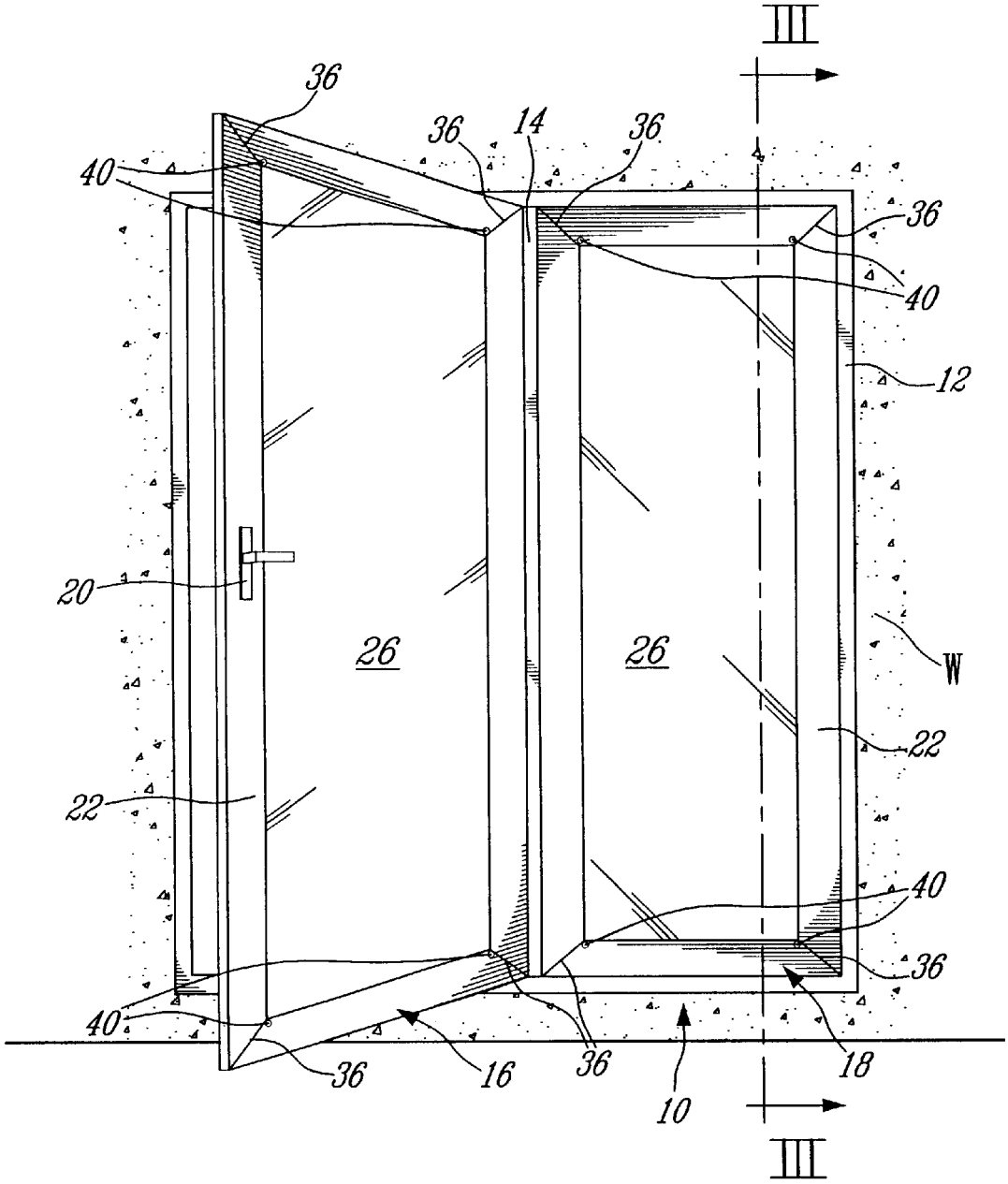
FIG. 1 is an exterior elevational view of windowed doors constructed in accordance with the present invention.
Figure 7:
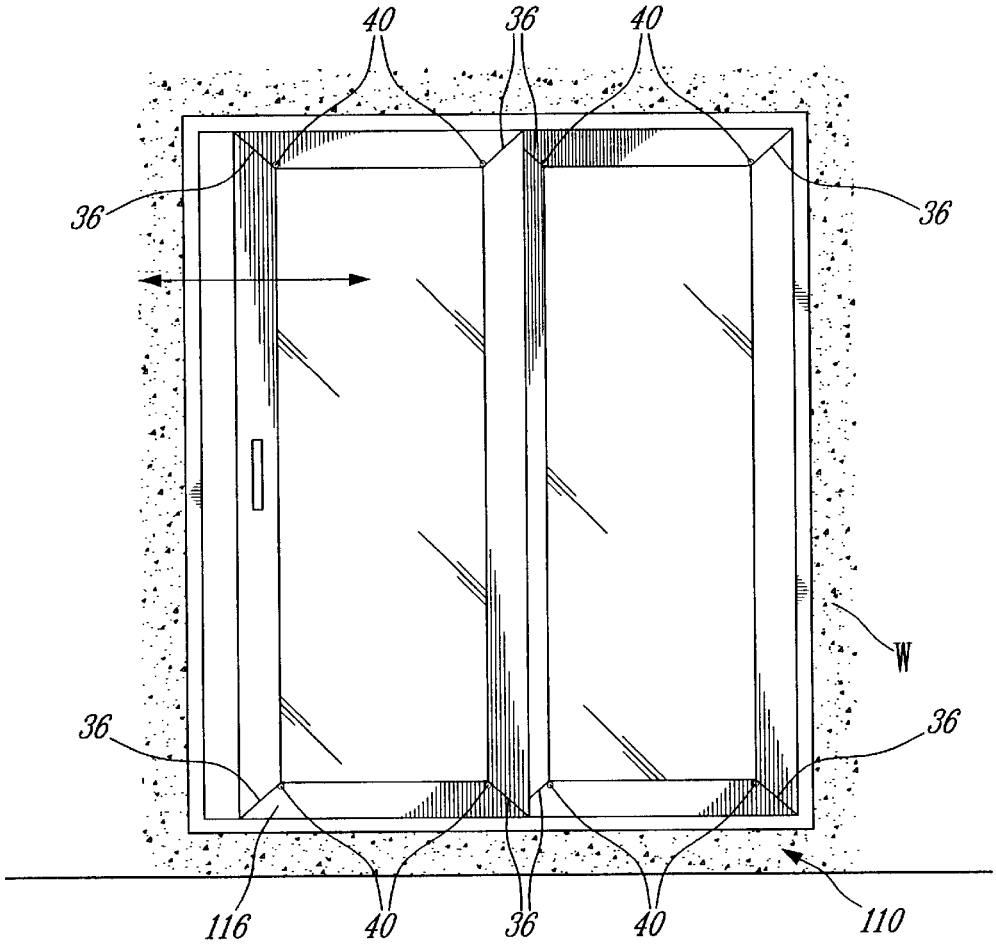
FIG. 7 is an interior elevational view of a patio door set constructed in accordance with the present invention.
Figure 8:
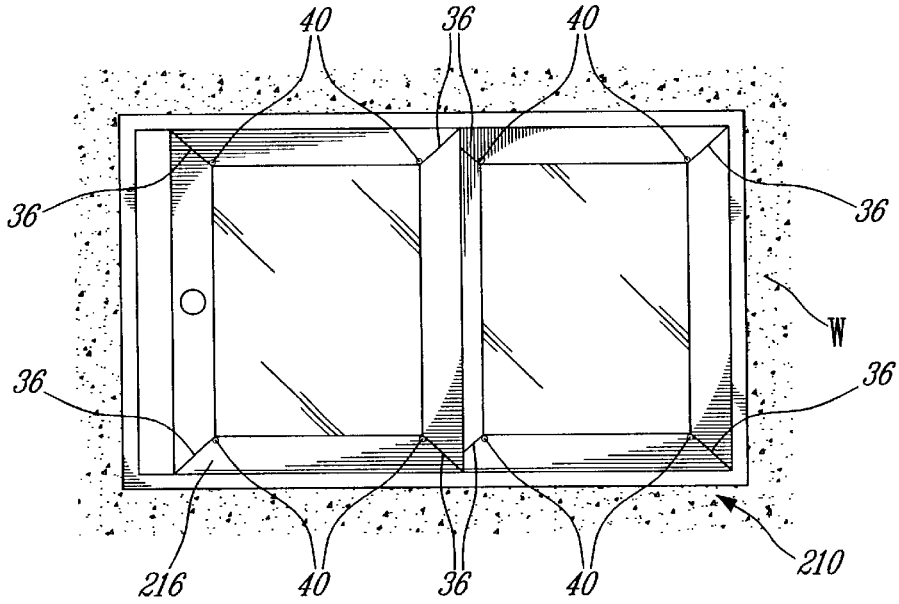
FIG. 8 is an interior elevational view of a windows constructed in accordance with the present invention.

Referring to the drawings, and more particularly to FIG. 1, windowed doors 10 constructed in accordance with the present invention is generally shown at 10. The windowed doors 10 are mounted to a wall W by a door frame 12 thereof. The door frame 12 is of rectangular shape and may have an astragal 14 extending vertically in the middle thereof to separate the windowed doors 10 into a pair of doors, namely an openable windowed door 16 and an immovable windowed door 18. The openable door 16 is herein shown as hinged to the astragal 14 (it could be connected instead to the door frame 12) in order to move from an open to a closed position. As shown in FIG. 1, the openable door 16 is in a partially open position. The openable door 16 has handles 20 on both sides thereof (only one of which is shown) so as to be opened when positioned in the closed position. Although the windowed doors 10 illustrated in FIG. 1 have a hinged openable door 16 and an immovable door 18, it is pointed out that other configurations of windowed doors 10 may be used in accordance with the modifications of the present invention, such as laterally sliding patio doors as shown in FIG. 7, double swing doors and the like. It is also possible to adapt the present invention to windows, as shown in FIG. 8, and as will be explained hereinafter.

Figure 2:
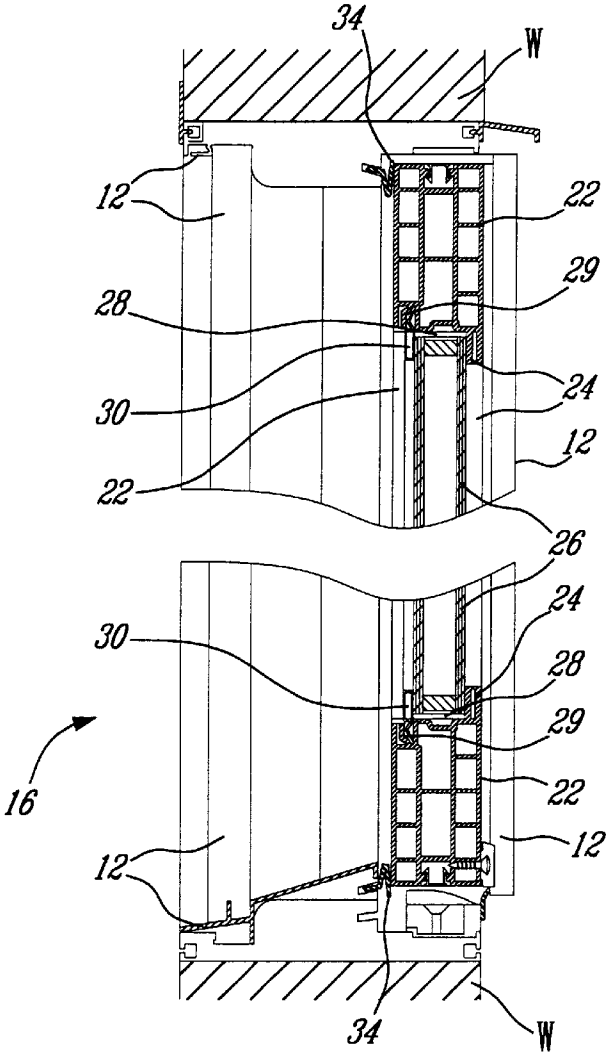
FIG. 2 is a cross-sectional view of an openable a hinged windowed door constructed in accordance with the present invention.

Referring now to FIG. 2, the openable door 16 is shown in a closed position with respect to the wall W. The openable door 16 has a windowed door sash 22 of rectangular periphery, sized so as to be received generally flush with an inner periphery of half of the door frame 12 limited by the astragal 14. The windowed door sash 22 has an outer lip 24 projecting inwardly. The openable door 16 further comprises a window pane 26 that is fixed in the windowed door sash 22 by setting blocks 28 on the outer periphery of the window pane 26. A glazing bead 30 is secured to an interior of the openable door 16 and seals the window pane 26 to the windowed door sash 22. The glazing bead 30 has a portion thereof received in a channel 29 in the window frame 22.

Figure 3:
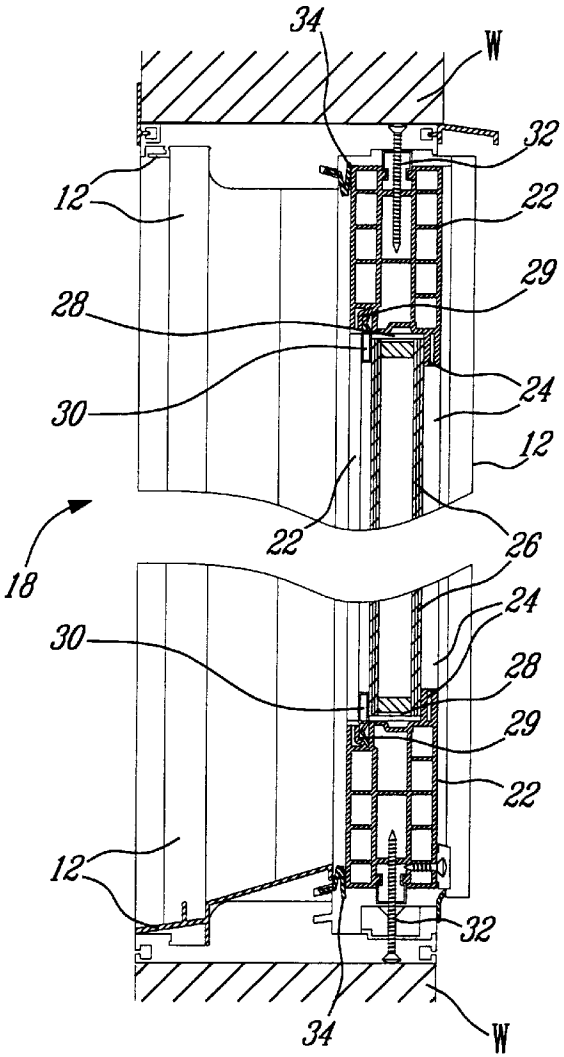
FIG. 3 is a cross-sectional view of the immovable windowed door of FIG. 1 taken along cross-sectional line III—III.

FIG. 3 illustrates the construction of the immovable door 18, which has components similar to the openable door 16 (i.e., windowed door sash 22, outer lip 24, window pane 26, setting block 28, glazing bead 30), and thus similar components are given the same reference numerals. The difference between the openable door 16 of FIG. 2 and the immovable door 18 of FIG. 3 resides in the fact that the immovable door 18 is immovable and is therefore secured to the door frame 12 via the bolts 32, whereas the openable door 16 is pivotably mounted to the door frame 12 and is herein hinged to the astragal 14. A weather stripping 34 ensures in both cases the sealing between the door frame 12 and the openable door 16 or the immovable door 18. As seen in FIGS. 2 and 3, the windowed door sash 22 of the openable door 16 and the immovable door 18 each consist of extruded profiled polymeric members. As seen in FIG. 1, the windowed door sashes 22 each have four elongated extruded members, having beveled out free ends so as to be welded to form the rectangular shape of the windowed door sashes 22. The seams of the welds between the elongated extruded members are shown at 36 and are present on both the interior and the exterior of the openable door 16 and the immovable door 18. The elongated extruded members consist in a polymeric material, such as polyvinyl chloride (PVC).

Figure 4:
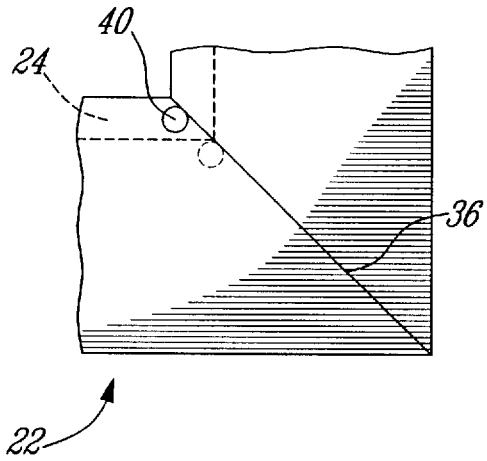
FIG. 4 is an enlarged exterior elevational view of a door sash of the windowed door constructed in accordance with the present invention.
Figure 5:
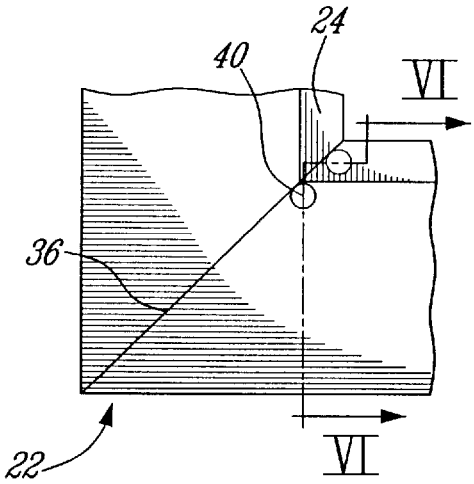
FIG. 5 is an enlarged interior view of the door sash.
Figure 6:
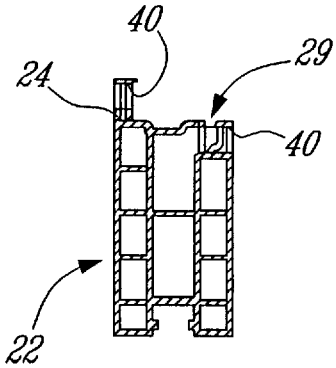
FIG. 6 is a cross-sectional view of the door sash taken along cross-sectional line VI—VI of FIG. 5.

As shown in FIG. 1, stress distributing dispatch holes 40 are disposed in the four corners of the openable door 16 and immovable door 18, and are more precisely positioned to contact the weld seams 36 so as to disrupt the stress in the area of the seams 36 and convect it over the surface area of the extruded members. Referring to FIGS. 4, 5 and 6, the stress distributing holes 40 are shown on both the interior and the exterior of the windowed door sash 22, which may be part of either the openable door 16 or the immovable door 18. On the exterior of the door 16 or 18, the stress distributing holes 40, as seen in FIG. 6, are positioned on the outer projecting lip 24. On the interior of the door 16 or 18, the stress distributing holes 40 extend through the channel 29. The stress distributing holes 40 are shown off center with respect to the weld seams 36, but still contact the seams 36. The requirement is that the stress distributing hole 40 disrupt the weld seams 36 and, therefore, the stress distributing hole 40 may be, at the minimum, tangential to the weld seams 36.

When the window pane 26 is subjected to an impact, a shock wave is propagated from the point of impact toward the windowed door sash 22. The shock wave is absorbed by the elongated members of the windowed door sash 22, and this will create a shock wave and stress on the weld seams 36 (especially at inside corners of the windowed door sash 22), which are the intersections of interconnected elongated extruded members having at least partially absorbed the shock wave of the window pane 26. The stress distributing holes 40 in contact with the weld seams 36 distribute the shock, that would normally be completely sustained by the weld seams 36, into the elongated members, and partially returned to the window pane 26. If there were no stress distributing holes 40, the weld seams 36 could split open because of the concentrated impact wave and stress on the weld seams, especially at inside corners of the windowed door sash 22. Otherwise, if the weld seams 36 were too rigid, the shock wave could be fully redistributed back into the elongated members of the windowed door sash 22 and the window pane 26 and could cause any one of these to break. Accordingly, the weld seams 36, via the stress distributing holes 40, are capable of resisting greater impacts than seams of windowed members without stress distributing holes. Moreover, as the shock is dispatched to the elongated members, the window pane 26 is also less subject to failure and to cracking. It is pointed out that some impact tests allow some cracks in the window pane 26, as long as these cracks, for instance, are no longer than 5 inches long and that there is no opening in the cracks large enough to be penetrated by a 3 inch diameter sphere. In such cases, it is preferred that the windowed door sash 22 remains intact should the window pane 26 crack, and this is achieved with the stress distributing holes 40.

More precisely, the holes 40 preferably have a diameter of ⅜ inch, and have their center located on the horizontal elongated members ¼ inch and 0.27 inch below (or above, accordingly) an upper horizontal surface (or lower, accordingly) of the horizontal elongated member, and their center being slightly offset from a continuation of vertical surfaces of the vertical elongated members toward the horizontal members. A pasty substance, such as a silicone, may be used to fill and hide the stress distributing holes 40.

As shown in FIGS. 7 and 8, the stress distributing holes 40 of the present invention are shown as used in contact with the weld seams 36 for impact shock stress distributing on the sashes of sliding windowed door sash 116 of patio doors 110, and on a sliding window sash 216 of a window 210.

Although the windowed members illustrated herein each have eight dispatch holes 40 (i.e., four dispatch holes 40 on each side as there are four weld seams), it is pointed out that in some cases, fewer dispatch holes 40 could enable the distribution of stress generated by impact shocks. For instance, in regions where the impact test standards have lower threshold values, the amount of dispatch holes 40 may be reduced.

It is within the ambit of the present invention to cover any obvious modifications of the preferred embodiment described herein, provided such modifications fall within the scope of the appended claims.

What is claimed is:

1. A windowed sash of the type having at least one window pane supported in a window sash, the window sash consisting of elongated profiled polymeric members interconnected by weld seams at joints therebetween, the window sash being adapted to be mounted in a frame;

wherein at least one hole is in contact with at least one of the weld seams interconnecting the elongated profiled polymeric extruded members for distributing, at least partially, stress sustained by at least one of the window pane and the window sash when subjected to shocks so as to prevent at least one of the weld seams, the elongated profiled polymeric extruded members and the window pane from cracking.

2. The windowed sash according to claim 1, wherein holes are provided in each of the weld seams on an interior and on an exterior of the extruded members of the windowed sash.

3. The windowed sash according to claim 1, wherein a center of the hole is offset with respect to the weld seam.

4. The windowed sash according to claim 1, wherein said hole has a diameter ranging between ¼ in and ½ in.

5. The windowed sash according to claim 4, wherein a center of the hole is at most ½ in offset vertically from the window pane, and horizontally offset at most by ¼ in from a vertical edge surface of the window sash.

6. The windowed sash according to claim 1, wherein the at least one hole is plugged for concealing said hole.

7. The windowed sash according to claim 1, wherein the windowed sash is one of window windowed sash and a door windowed sash.

8. A method for increasing a shock resistance of a windowed sash, the windowed sash having a window sash being formed by elongated profiled polymeric extruded members interconnected at joints by weld seams, and a window pane supported in the window sash, the method comprising the step of:

providing at least one hole in contact with at least one of the weld seams for distributing, at least partially, stress sustained by at least one of the window pane and the window sash when subjected to shocks so as to prevent at least one of the weld seams, the elongated profiled polymeric extruded members and the window pane from cracking.

9. The method according to claim 8, further comprising the step of plugging the at least one hole for concealing said hole.

* * * * *